US007330172B2

(12) United States Patent
Itoh et al.

(10) Patent No.: US 7,330,172 B2
(45) Date of Patent: Feb. 12, 2008

(54) IMAGE DISPLAY DEVICE AND IMAGE DISPLAY METHOD

(75) Inventors: Motomitsu Itoh, Mie (JP); Kazunori Mukai, Matsusaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 619 days.

(21) Appl. No.: 10/390,639

(22) Filed: Mar. 19, 2003

(65) Prior Publication Data

US 2003/0201968 A1 Oct. 30, 2003

(30) Foreign Application Priority Data

Mar. 25, 2002 (JP) ..... 2002-084290
Jan. 22, 2003 (JP) ..... 2003-013384

(51) Int. Cl.
*G09G 3/36* (2006.01)

(52) U.S. Cl. ..... 345/102

(58) Field of Classification Search ..... 345/102, 345/87–89, 98
See application file for complete search history.

(56) References Cited

U.S. PATENT DOCUMENTS 5,812,149 A * 9/1998 Kawasaki et al. ..... 345/98
6,839,048 B2 * 1/2005 Park ..... 345/102
2002/0021292 A1 * 2/2002 Sakashita ..... 345/204

FOREIGN PATENT DOCUMENTS

JP 06-102484 4/1994
JP 11-065528 3/1999

* cited by examiner

*Primary Examiner*—Amr A. Awad
*Assistant Examiner*—Steven E Holton
(74) *Attorney, Agent, or Firm*—Harness, Dickey & Pierce, PLC

(57) ABSTRACT

An image display device controls the video signal and the lighting circuit according to the input video signal, so as to improve contrast, so that flicker or "bright black display", which may be caused when the display characteristics do not match the human visual characteristics, is eliminated. The image display device includes a filter circuitry, in which a filter selecting circuit changes the filter characteristic according to the difference of a video signal and memory data stored in a memory circuit. The filter circuitry selects different filter characteristics for the display change from dark to bright and for the display change from bright to dark. This prevents display flicker, which may be caused due to saturation of human visual perception with respect to changes in gradation and illuminance level.

5 Claims, 9 Drawing Sheets

IMAGE DISPLAY DEVICE AND IMAGE DISPLAY METHOD

FIELD OF THE INVENTION

The present invention relates to an image display device and an image display method that display an input video signal on a display panel. The invention particularly relates to an image display device and an image display method that select an intensity of a light source according to the input video signal when projecting light onto the display panel displaying the video signal.

BACKGROUND OF THE INVENTION

One example of an image display device that displays an input video signal on a display panel such as a liquid crystal panel is disclosed in Japanese Publication for Unexamined Patent Application No. 65528/1999 (Tokukaihei 11-65528, published on Mar. 9, 1999).

The image display device disclosed in this publication processes an input video signal and displays it on a liquid crystal panel. In addition, the light source projects light on the liquid crystal panel according to the input video signal.

Referring to FIG. 8, a schematic structure of an image display device 80 of the foregoing publication is described below.

The image display device 80 includes a low-pass filter 81, a peak value detector 82, a high-frequency cut filter 83, a lighting circuit 84, a light source 85, a video signal processing circuit 86, a driver 87, and a liquid crystal panel 88.

The low-pass filter 81 removes a high-frequency component of the video signal 89 it receives, and outputs a low-pass filter output signal 90.

The peak value detector 82 detects and holds a peak value of the low-pass filter output signal 90, and outputs a peak value signal 91.

As will be described later, the image display device 80 according to the foregoing configuration successively displays images on a frame basis. Accordingly, the "peak value" is meant to indicate, for example, a pixel-wise peak value of the video signal in one frame with respect to each color component.

The peak value detector 82 has a function known as a peak-hold function, and the detected peak value is attenuated with a time constant of substantially one frame. In this way, a peak value can be detected per frame.

The high-frequency cut filter 83 outputs a filter output signal 92, which is produced by slowing the change of the peak value signal 91, to the lighting circuit 84 and the video signal processing circuit 86.

In the liquid crystal panel 88, the time required for the display compensation is comparatively longer than that required for the compensation of light intensity of the light source 85. It is for this reason that the high-frequency cut filter 83 slows the signal change, so that the operation of display compensation in the liquid crystal panel 88 can properly follow the change in light intensity of the light source 85.

Another reason the high-frequency cut filter 83 slows the rate of change of light intensity of the light source 85 is to prevent display flicker, which occurs when the intensity of the light from the light source 85 changes abruptly.

The lighting circuit 84 processes the filter output signal 92 by pulse width modulation control for example, and outputs a lighting circuit output signal 93 to the light source 85. The light source 85 projects light onto the liquid crystal panel 88 with the intensity according to the lighting signal output signal 93.

The video signal processing circuit 86 processes the video signal 89 according to the filter output signal 92, and outputs a video signal processing circuit output signal 94 to the driver 87.

The driver 87 displays an image on the liquid crystal panel 88 according to the video signal processing circuit output signal 94.

In response to the video signal 89 via the low-pass filter 81 and the video signal processing circuit 86, the image display device 80 according to the foregoing configuration operates in the manner described below. Namely, the image display device 80 processes the video signal 89 and displays it on the liquid crystal panel 88. In addition, the image display device 80 lights the light source 85 according to the video signal 89, so as to project light onto the liquid crystal panel 88.

More specifically, in response to the video signal 89, the image display device 80 according to the foregoing configuration processes the video signal 89 by the described operations of the respective constituting elements, so that an image is displayed on the liquid crystal panel 88 by the driver 87.

Here, the driver 87 of the image display device 80 displays the video signal with respect to each pixel of the liquid crystal panel 88, so as to display a complete image over the entire screen.

The image display device 80 displays an image of one frame over a predetermined time period in the described manner, and the next frame is displayed based on the next input of the video signal. By repeating this process, a desired image (moving image) is displayed on the liquid crystal panel 88.

The output value of the light source 85 is updated according to the video signal every time the liquid crystal panel 88 is refreshed per frame.

Referring to FIG. 9, switching operations of the video signal and the lighting control signal will be described below.

FIG. 9 shows a timing chart, in which the horizontal axis indicates time and the vertical axis indicates signal intensity. The periods T11 through T15 on the upper part of FIG. 9 indicate time intervals.

A signal 95 is one example of the peak value signal 91 shown in FIG. 8. The periods T11, T13, and T15 indicate time periods in which the video signal has a large peak value with respect to each color component, i.e., the periods of bright display. On the other hand, the periods T12 and T14 indicate time periods in which the video signal has a small peak value with respect to each color component, i.e., the periods of dark display.

As FIG. 9 indicates, the signal 95 as one example of the peak value signal 91 changes over time according to the level of brightness of the video signal.

A signal 96 of FIG. 9 in the example of the signal 95 corresponds to the filter output signal 92 of FIG. 8. Namely, the signal 96 is produced by processing the signal 95 in the high-frequency cut filter 83, the signal 95 being one example of the peak value signal 91. The signal 95 (96) is supplied to the lighting circuit 84 to produce therein the driving signal 93 for the light source 85.

A signal 97 of FIG. 9 in the example of the signal 95 corresponds to the video signal processing circuit output signal 94 of FIG. 8. That is, the signal 97 is a signal that is produced by processing the signal 95, which is one example of the peak value signal 91, in the high-frequency cut filter 83 and subsequently in the video signal processing circuit 86. The signal so produced is supplied to the driver 87, so as to output a driving signal to the liquid crystal panel 88.

Signals 98 and 99 shown in FIG. 9 are signals that are produced when the effects of the high-frequency cut filter 83 are enhanced.

That is, the signal 98 of FIG. 9 in the example of the signal 95 corresponds to the filter output signal 92 of FIG. 8, and it enhances the effects of the high-frequency cut filter 83.

The signal 99 of FIG. 9 in the example of the signal 95 corresponds to the video signal processing circuit output signal 94 of FIG. 8, and it enhances the effects of the high-frequency cut filter 83.

By thus using the high-frequency cut filter 83, changes in illumination intensity and changes in video signal do not cause a significant change in a display state of the liquid crystal panel. As a result, flicker can be prevented.

Referring to FIG. 9, the following considers the case where the display changes from bright to dark at the transition of T11 to T12, for example.

In this case, the signal 95, which is a peak value signal, changes from High level to Low level. The signal 96 also changes from High level to Low level, while the signal 97, which is a video signal processing circuit output signal, changes from Low level to High level.

On the other hand, when the display changes from dark to bright, for example, at the transition of T12 to T13, the signals 95 and 96 changes from Low level to High level, while the signal 97 changes from High level to Low level.

The signals 98 and 99, which are produced when enhancing the effects of the high-frequency cut filter 83, show a similar pattern of change as the signals 96 and 97. As described, in the image display device 80, the signal 96 for controlling the lighting circuit is also changed at the timing of change of the peak value signal 95 from bright display to dark display, or from dark display to bright display.

However, in the image display device 80, the same lighting control is employed for the display change of from dark to bright and from bright to dark. This increases the likelihood of display flicker when the display changes, for example, from bright display to dark display.

That is, in the image display device 80, the high-frequency cut filter 83 carries out the same control for the display change of from dark to bright and from bright to dark.

Accordingly, the filter output signal 92 changes at the same rate when the display changes from dark to bright and from bright to dark. The lighting circuit output signal 93 processed in the lighting circuit 84 also shows the same change.

As a result, the displayed image does not change smoothly, and, when a change in quantity of light is too large, flicker is caused, and in other cases, the "bright black display" phenomenon, in which a black scene appears too bright, may be caused in the display.

This is due to saturation of human visual characteristics with respect to changes in gradation and illuminance level. In a display change from dark display to bright display and from bright display to dark display, the degree of change perceived by the observer will not be the same even if the display change is controlled under the same conditions. For example, display flicker may be caused when the same control is carried out for the display change from bright to dark and from dark to bright. In this case, the displayed image does not match the human visual characteristics, and the observer fails to recognize the image properly.

SUMMARY OF THE INVENTION

The present invention was made in view of the foregoing problems, and it is an object of the present invention to provide an image display device and an image display method that are capable of preventing display flicker, which may be caused due to saturation of human visual perception with respect to changes in gradation and illuminance level of the display.

In order to achieve the foregoing object, the present invention provides an image display device that includes: a light source; a display panel, which outputs light from the light source by controlling an illuminance level of the light according to a level of a video signal; and a light source control section for controlling an output of the light source according to an output signal that is generated according to a level of the video signal, the image display device further including: a comparing section for comparing the video signal with a last output signal, so as to output a result of comparison; and a characteristic changing section for changing an output characteristic of the light source control section according to the result of comparison.

According to this configuration, in addition to displaying the video signal on the display panel, the image display device compares the input video signal with the last output signal, so as to control the output of the light source based on an output signal that was generated by changing the output characteristic according to the result of comparison.

That is, the image display device generates the output signal by referring to not only the video signal being displayed on the display panel under illumination but also the last output signal (immediately preceding one) that was generated based on the video signal previously displayed on the display panel.

Here, "changing the output characteristic of the light source control section according to the result of comparison" means, for example, changing the output level of the light source according to the result of comparison.

That is, in changing gradations by refreshing images per frame in the display panel, the output that was generated according to the last frame image is referred to in addition to the video signal, so as to suitably generate an output signal in conformity with the human perception, by taking into account saturation of the human visual perception. The output of the light source is controlled by the output signal so obtained. In this way, display flicker can be suppressed.

For example, the "bright black display" phenomenon, which may occur when a dark image is displayed, can be suppressed by conforming to the human visual characteristics, thereby displaying a high-contrast and high-quality image.

Further, a high-contrast image can be obtained by changing the output characteristic such that, for example, the intensity of light increases steeply when the display changes from dark to bright in the display panel, and decreases slowly when the display change is from bright to dark. In order to achieve this, the characteristic changing section may be adapted to change the output characteristic of the light source changing section according to whether the result of comparison indicates increase or decrease.

It is preferable in the foregoing configuration that the input video signal is the output of the peak value detector for detecting a peak value.

In this way, a gain of the video signal can be varied to obtain a high-contrast image, for example.

Further, in the foregoing configuration, other than comparing signals of adjacent frames, the video signal and the last output signal may also be compared with each other by comparing signals of discrete frames, when the signals cause a change in illuminance level over an extended time period. It is preferable in this case to provide a memory section for storing the output signal, so that the output signals of predetermined frames can be stored in the memory section, and the video signal can be compared with the output signals stored in the memory section.

Note that, in the foregoing configuration, the output signal compared by the comparing section may be stored, for example, in the memory section, or alternatively supplied to, for example, a delaying circuit so that the output signal is supplied therefrom by being delayed.

The present invention therefore provides an image display device that can limit display flicker, which may be caused due to saturation of human visual perception with respect to changes in gradation and illuminance level of the display.

Further, in order to achieve the foregoing object, the present invention provides an image display method for controlling an output of a light source for illuminating a display panel displaying a video signal, based on an output signal that is produced using the video signal, the method including the steps of: comparing the video signal with a last output signal; and producing an output signal according to a result of comparison in the comparing step. According to this method, the light source projects light on the display panel displaying the video signal, for example, per frame, by newly generating an output signal referring to the output signal (the last output signal) that was generated according to the image of the last frame. That is, in the step of generating an output signal, not only the current video signal but also the last output signal is used. This suitably produces an output signal that takes into account saturation of human visual perception or records of human perception.

For a fuller understanding of the nature and advantages of the invention, reference should be made to the ensuing detailed description taken in conjunction with the accompanying drawings.

DESCRIPTION OF THE EMBODIMENTS

One embodiment of the present invention is described below.

An image display device 1 of the present embodiment processes an input video signal so as to display it on a liquid crystal panel that is provided as a display panel. The input video signal is used by the image display device 1, so that a light source projects light on the liquid crystal panel according to the input video signal.

Figure 1:
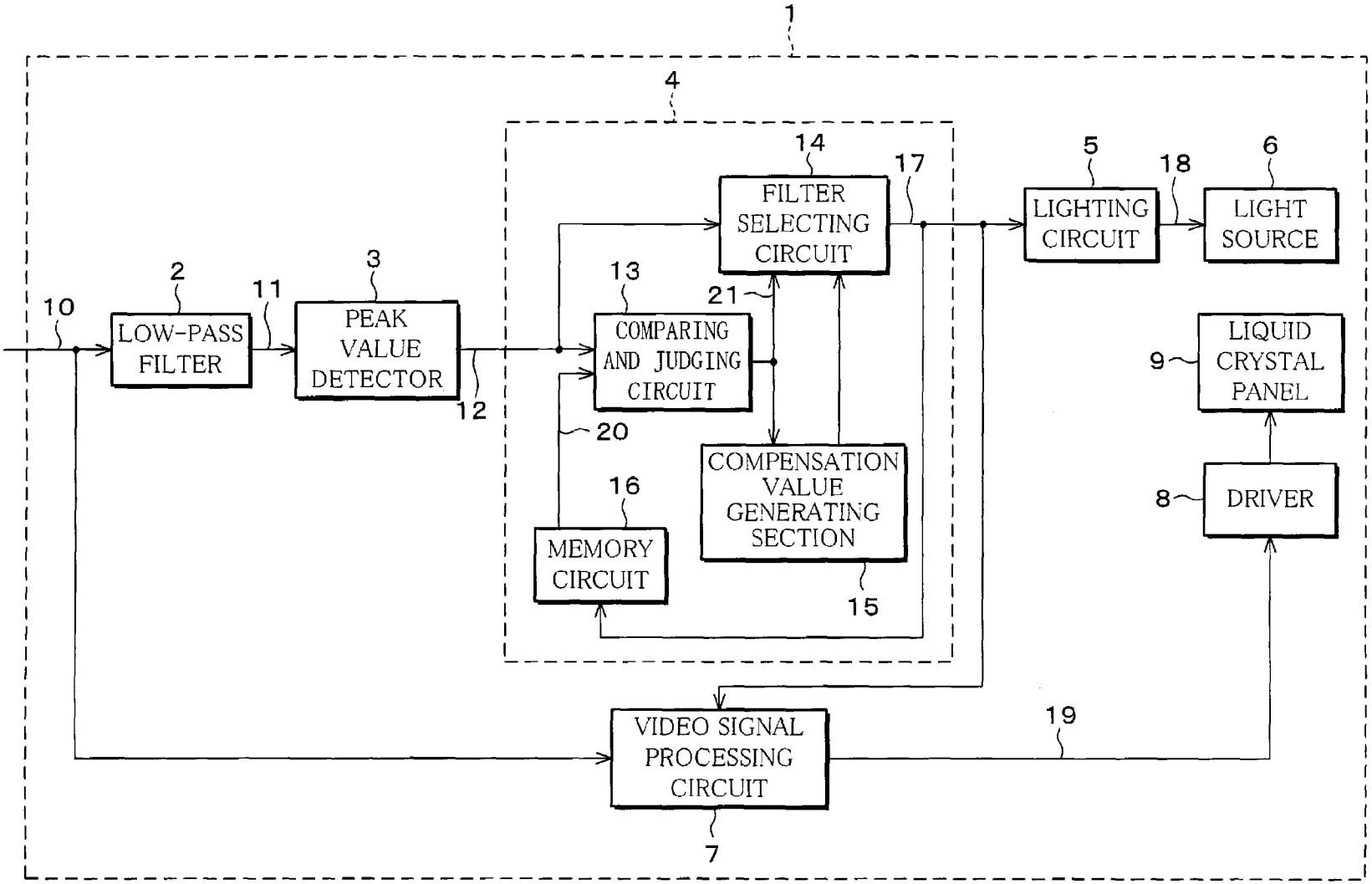
FIG. 1 is a block diagram showing an image display device according to one embodiment of the present invention.

The image display device 1 includes a low-pass filter 2, a peak value detector 3, filter circuitry (light source control section) 4, a lighting circuit 5, a light source 6, a video signal processing circuit 7, a driver 8, and a liquid crystal panel (display panel) 9, as shown in FIG. 1.

The low-pass filter 2 is provided to remove a high-frequency component of a video signal 10 and outputs a low-pass filter output signal 11.

The peak value detector 3 detects and holds a peak value of the low-pass filter output signal 11, and outputs a peak value signal 12.

Here, as will be described later, the image display device 1 successively displays images per frame. Accordingly, as the term is used herein, "peak value" means, for example, a pixel-wise peak value of the video signal in one frame.

The peak value detector 3 has a function known as a peak-hold function, and the detected peak value is attenuated with a time constant of substantially one frame. In this way, a peak value can be detected per frame.

In some video signals of a television for example, two fields constitute one frame. In such a case, the peak value may be a pixel-wise peak value of one field, for example. In this case, the following description, which is based on frame, may be directly applied to field.

The filter circuitry 4 includes a comparing and judging circuit (comparing section) 13, a filter selecting circuit (characteristic changing section) 14, a compensation value generating circuit (characteristic changing section) 15, and a memory circuit (comparing section) 16, which will be described later.

The filter circuitry 4 processes the peak value signal 12 it receives, and outputs a filter output signal 17.

The lighting circuit 5 receives and processes the filter output signal 17 and outputs a lighting circuit output signal 18 to the light source 6, so as to adjust the brightness of the light source 6.

The video signal processing circuit 7 receives the video signal 10 and processes it according to the filter output signal 17, so as to output a video signal processing circuit output signal 19 to the driver 8.

The driver 8 displays an image on the liquid crystal panel 9 according to the video signal processing circuit output signal 19.

In the described manner, the image display device 1 processes the video signal 10 to carry out display on the liquid crystal panel 9. The video signal is used by the image display device 1, so that the light source 6 projects light on the liquid crystal panel 9 according to the input video signal.

In response to the video signal 10 via the low-pass filter 2 and the video signal processing circuit 7, the image display device 1 according to the foregoing configuration operates in the manner described below. Namely, the image display device 1 processes the video signal 10 and displays it on the liquid crystal panel 9. In addition, the image display device 1 lights the light source 6 according to the video signal 10, so as to project light onto the liquid crystal panel 9.

More specifically, in response to the video signal 10, the image display device 1 according to the foregoing configuration processes the video signal 10 by the described operations of the respective constituting elements, so that an image is displayed on the liquid crystal panel 9 by the driver 8.

Here, the driver 8 of the image display device 1 displays the video signal with respect to each pixel of the liquid crystal panel 9, so as to display a complete image over the entire screen.

In this manner, the image display device 1 displays an image of one frame over a predetermined time period, and the next frame is displayed based on the next input of the video signal. By repeating this process, a desired image (moving image) is displayed on the liquid crystal panel 9.

That is, a desired image (moving image) is displayed on the liquid crystal panel 9 by refreshing the displayed frame image on the display screen faster than the human can perceive it.

In the described configuration, the light source 6 is generally a single light source, and projects light on the liquid crystal panel 9 with an output level according to the peak value of the video signal creating an image of one frame.

The output value of the light source 6 is updated according to the video signal every time the liquid crystal panel 9 is refreshed per frame.

Such a switching operation of the video signal and lighting control signal is realized by the filter circuitry 4 of the image display device 1 structured below.

The filter circuitry 4 determines the characteristic of the filter using the peak value supplied from the peak value detector 3.

For this purpose, the filter circuitry 4, using the peak value signal 12 from the peak value detector 3 as a target value, determines the difference between this target value and a stored value in the memory circuit 16, so as to vary its output value (filter output signal 17) toward the target value according to the difference, as will be described later.

Further, the filter circuitry 4 switches the filter characteristics according to the sign of the difference, whether the difference is positive or negative.

This is to increase the rate of change of light intensity of the light source when the brightness is to be increased from the current value, and to decrease it when the brightness is to be decreased from the current value. In this way, saturation of gradation expression can be reduced, so as to improve the image quality as perceived by the human eye.

The comparing and judging circuit 13 of the filter circuitry 4 is provided to determine the difference between the target value and the current value, as will be described later.

Here, the target value corresponds to the peak value signal 12.

The current value corresponds to the memory data 20, which is a value given by the filter output signal 17 of the last frame stored in the memory circuit 16.

The comparing and judging circuit 13, in addition to determining the difference between the peak value signal 12 and the memory data 20, outputs a control signal 21 to the filter selecting circuit 14. The control signal 21 is used to vary the filter output signal 17 toward to the value of the peak value signal 12.

In response to the control signal 21, the filter selecting circuit 14 selects a filter characteristic in the manner described below, and the filter characteristic so selected by the peak value signal 12 is used to produce a value by filter processing, which value is then outputted as the filter output signal 17.

The compensation value generating section 15, in response to the control signal 21 from the comparing and judging circuit 13, outputs a value that is used by the filter selecting circuit 14 to select the filter characteristic. That is, the compensation value generating section 15 generates and outputs a value that determines the filter characteristic according to the difference of the peak value signal 12 and the memory data 20. Here, the output value of the compensation value generating section 15 may be obtained not only by calculations but also by other means, for example, by referring to a stored table. Details of the value (compensation value) for determining the filter characteristic will be described later.

The memory circuit 16 stores the filter output signal 17 from the filter selecting circuit 14 as the memory data 20, so that the memory data 20 can be compared with the target value, i.e., the peak value signal 12, for the display of the next frame.

Note that, in the structure shown in FIG. 1, the filter circuit section 14 receives the peak value signal 12, and the control signal 21 from the comparing and judging circuit 13. However, the structure of the filter circuitry 4 of the image display device 1 is not limited thereto. For example, when the comparing and judging circuit 13 is realized by a difference calculating circuit that calculates a difference, the value indicated by the control signal 21 corresponds to the difference. In this case, the filter selecting circuit 14 can obtain the memory data 20 from the peak value signal 12 and the difference. Thus, in the structure of FIG. 1, the filter selecting circuit 14 may receive the memory data 20 from the memory circuit 16, instead of the peak value signal 12. In this case, the filter selecting circuit 14 produces the filter output signal 17 from the memory data 20 and the difference.

Figure 2:
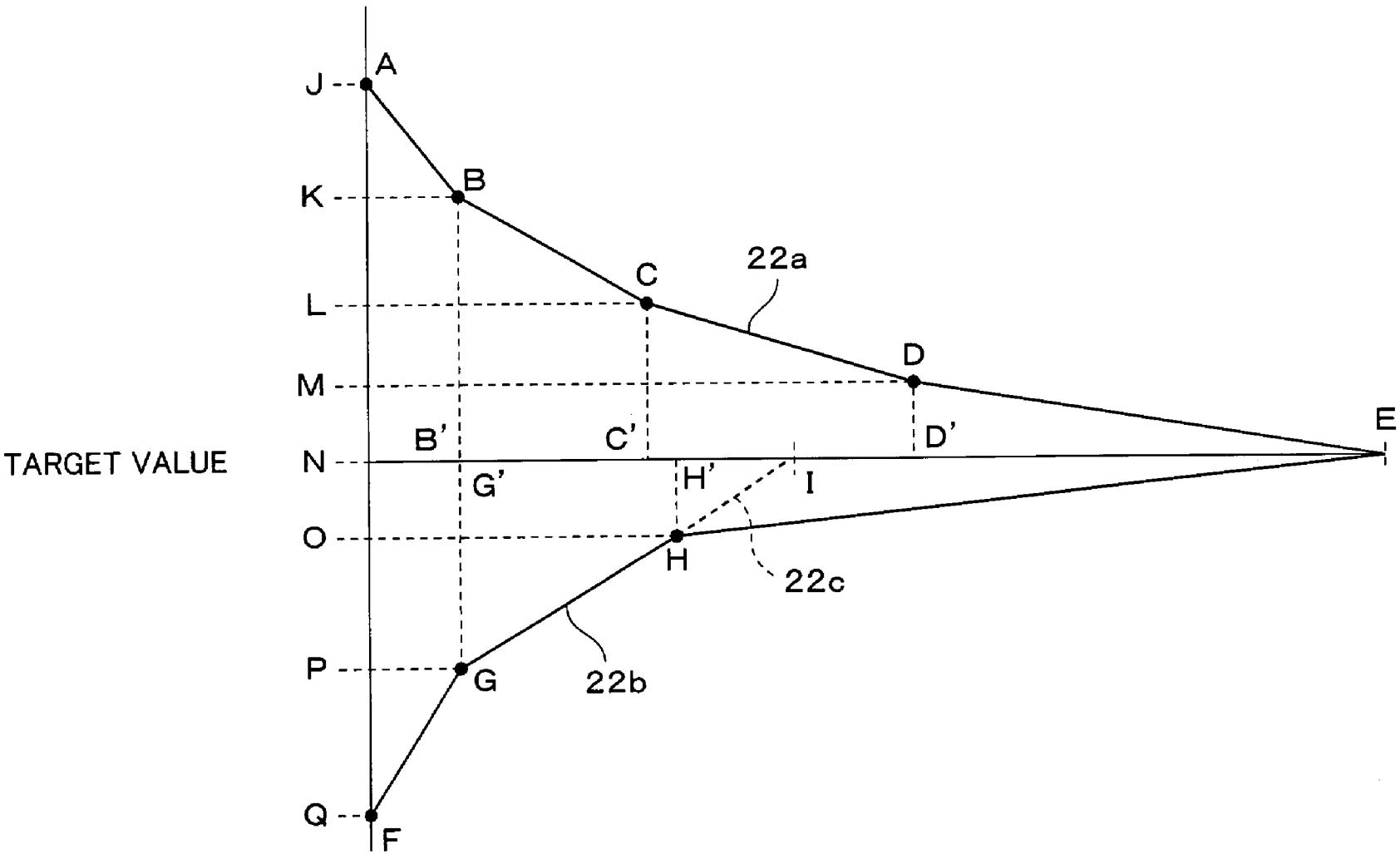
FIG. 2 is a graph showing characteristics of a filter circuit section in the image display device.

Referring to FIG. 2, the following describes how the filter selecting circuit 14 selects a filter characteristic.

In FIG. 2, the vertical axis indicates differences in gradations of the control signal 21, which derive from the filter output signal 17 of the last frame, with respect to the peak value signal 12 as a reference target value. The horizontal axis indicates time.

Namely, J, K, L, M, N, O, P, Q on the vertical axis are gradations with respect to the target value N.

On the horizontal axis, B', C', D', G', and H' indicate specific times, respectively corresponding to B, C, D, G, and H on filter characteristics 22*a* and 22*b*.

Further, on the horizontal axis, I indicates the time at which the target value is reached using a filter characteristic 22*c*, where the filter characteristic 22*c* is obtained by connecting F, G, H, and I by increasing the slope of the filter characteristic 22*b*, which connects F, G, H, and E.

As shown in FIG. 2, the filter characteristic 22*a* is selected when successively decreasing the value toward the target value, as the line connecting A, B, C, D, and E indicates, and it is used when the video signal changes from bright display to dark display.

That is, the filter characteristics 22*a* is selected when the difference of the control signal 21, which derives from the filter output signal 17 of the last frame, is positive with respect to the peak value signal 12 as a target value.

The filter characteristic 22*b* is selected when successively increasing the value toward the target value, as the line connecting F, G, H, and E indicates, and it is used when the video signal changes from dark display to bright display.

That is, the filter characteristics 22*b* is selected when the difference of the control signal 21, which derives from the filter output signal 17 of the last frame, is negative with respect to the peak value signal 12 as a target value.

Note that, point J on the vertical axis where the filter characteristic 22*a* meets indicates the maximum value of an output signal from the peak value detector 3 in bright display.

On the other hand, point Q on the vertical axis where the filter characteristic 22*b* meets indicates the maximum value of an output signal from the peak value detector 3 in dark display.

The filter characteristic 22*a* shown in FIG. 2 is determined by the slopes AB, BC, CD, and DE. The slopes are obtained from a decrement of gradation and from the duration (target time) of the decrement.

For example, the slope AB can be determined from the decrement of gradation from J to K, and from time B'. The slopes BC, CD, and DE can also be obtained in this manner.

The slopes FG, GH, and HE of the filter characteristic 22*b* shown in FIG. 2 can also be obtained in the described manner, except that in this case an increment of gradation and the duration of the increment are used.

The filter characteristic 22*c* shown in FIG. 2 can be determined from the slopes FG and GH, and from the slope HI, whose gradient is the same as GH. After time H', the slope HI of the filter characteristic 22*c* is selected instead of the slope HE of the filter characteristics 22*b*. This is because a high contrast image can be obtained by steeply increasing the light intensity when the display changes from dark to bright.

According to the foregoing configuration, the image display device 1 of the present embodiment operates as follows.

Figure 3:
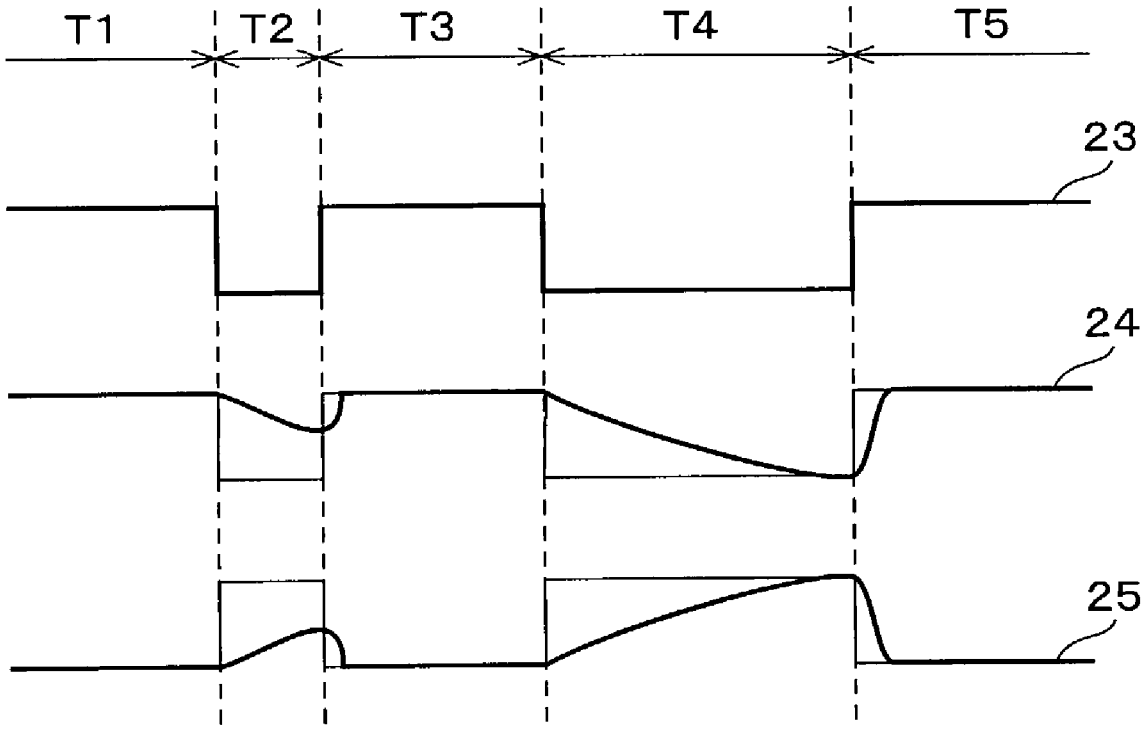
FIG. 3 is a timing chart showing one example of how signals processed in the image display device change as a function of time.

Referring to FIG. 3, the following describes the switching operation of the video signal and lighting control signal by the image display device 1.

FIG. 3 shows a timing chart, in which the horizontal axis indicates time and the vertical axis indicates signal intensity. The periods T1 through T5 on the upper part of FIG. 3 indicate time intervals.

A signal 23 is one example of the peak value signal 12 shown in FIG. 1. The periods T1, T3, and T5 indicate time periods in which the video signal has a large peak value with respect to each color component, i.e., the periods of bright display. On the other hand, the periods T2 and T4 indicate time periods in which the video signal has a small peak value with respect to each color component, i.e., the periods of dark display.

As FIG. 3 indicates, the signal 23 as one example of the peak value signal 12 changes over time according to the level of brightness of the video signal 12.

A signal 24 in the example of the signal 23 in FIG. 3 corresponds to the filter output signal 17 of FIG. 1. Namely, the signal 24 is produced by processing the signal 23 in the filter circuitry 4, the signal 23 being one example of the peak value signal 12. The signal 24 is supplied to the lighting circuit 5 to produce therein the driving signal 18 for the light source 6.

A signal 25 in the example of the signal 23 in FIG. 3 corresponds to the video signal processing circuit output signal 19 of FIG. 1.

With the use of the filter circuitry 4, it is possible to prevent flicker on the liquid crystal panel 9, which may be caused when there are changes in luminous intensity and video signal. The following describes how this is achieved. In the example of FIG. 3, the display changes from bright to dark at the transition of T1 to T2.

In this case, the signal 23, which is a peak value signal, changes from High level to Low level. The signal 24 also changes from High level to Low level, while the signal 25, which is a video signal processing circuit output signal, changes from Low level to High level.

In the present embodiment, the filter characteristic 22*a* of gradual slopes is used when the display changes from bright to dark as described in FIG. 2, and when the bright display is restored after a brief period of dark display. In this way, the intensity of light from the light source is prevented from decreasing to the level where it causes fluctuations of leaking light in black display, thereby preventing flicker.

On the other hand, when the display changes from dark to bright, for example, at the transition of T2 to T3, the signals 23 and 24 changes from Low level to High level, while the signal 25 changes from High level to Low level. In the present embodiment, the filter characteristic 22*b* or 22*c* of steep slopes is used when the display changes from dark to bright as described in FIG. 2. In this way, a high contrast image can be displayed.

Further, as already described in reference to FIG. 2, the filter characteristic 22*a* of gradual slopes is used when the display changes from bright to dark, for example, at the transition of T3 to T4, and when a relatively long period of dark display follows, as shown in FIG. 3. In this way, dark display can be achieved with a small change of light intensity.

Contrary to the video signal controlled in the lighting circuit 5, the video signal supplied to the liquid crystal panel 9 (display panel) is controlled to have a gain in dark display and no gain in bright display, so as to prevent "bright black display" in a black scene.

For example, there are cases where a long period of dark display, such as an end title of a movie displaying scrolling images of white characters on a black background, suddenly changes to bright display. In such display, a conventional image display device causes the black display to appear too bright due to a sudden change in illuminance level from dark display to bright display.

In the image display device 1, the signal 24 that is used to control the lighting circuit is also changed according to the timing of change of the peak value signal 12, from bright display to dark display, or from dark display to bright display.

Figure 4:
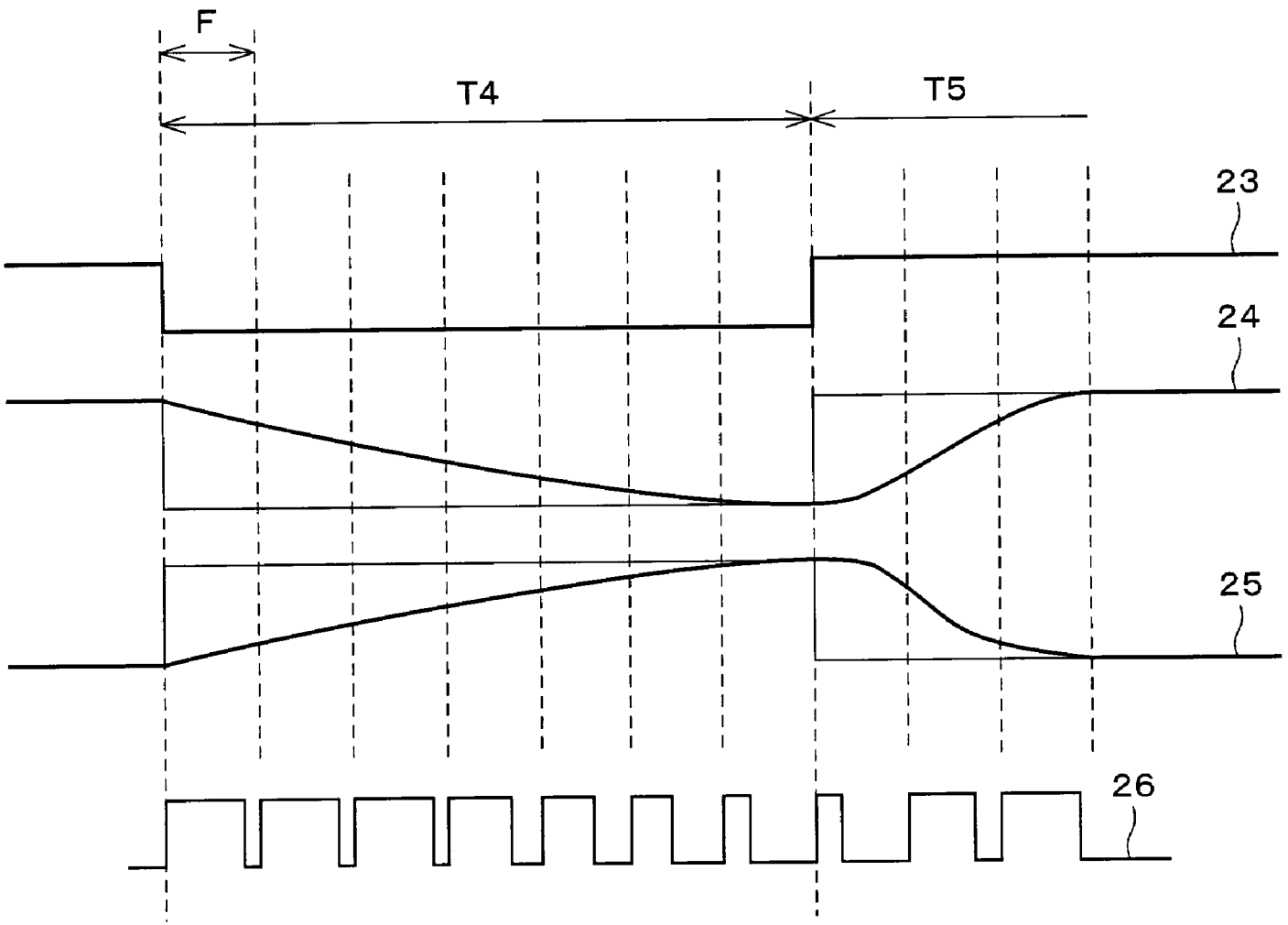
FIG. 4 is a timing chart magnifying a portion of the timing chart of FIG. 3.

FIG. 4 is a timing chart magnifying the period T4 and period T5 of FIG. 3.

In FIG. 4, a period F is a one frame interval.

Here, a signal 26 is a signal that is produced in the lighting circuit 5 to control the light source 6, using the signal 24 as one example of the filter output signal 17 supplied to the lighting circuit 5.

The signal 26 has a waveform as shown in FIG. 4 when the lighting circuit 5 adjusts the light intensity by adjusting the driving signal 18 according to a PWM (Pulse Width Modulation) method.

As shown in FIG. 4, in a period of dark display as in T4, the pulse width of the signal 26 gradually becomes shorter per frame, so as to reduce the quantity of light emitted by the light source 6.

On the other hand, in a period of bright display as in T5, the pulse width of the signal 26 is gradually increased per frame, so as to increase the quantity of light emitted by the light source 6.

The light source 6 is controlled in this manner by the lighting circuit 5. Note that, other than using the PWM method, the light source 6 may be controlled by controlling current.

Referring to the drawings, more specific examples of the filter circuitry 4 are described below.

Figure 5:
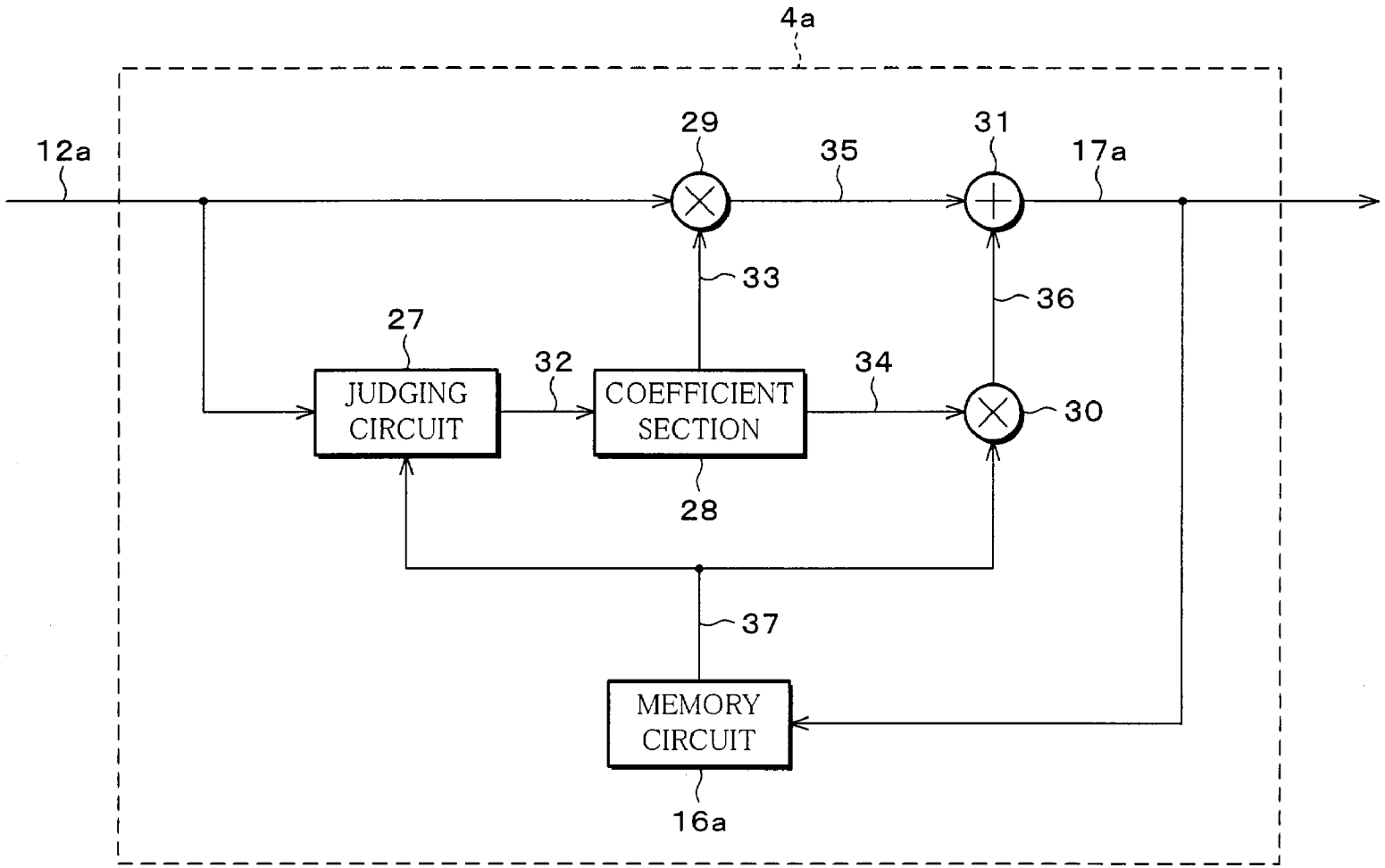
FIG. 5 is a block diagram showing one example of the filter circuit section of the image display device.

First, a First Example of the filter circuitry 4 is described with regard to its function of light adaptation, with reference to FIG. 5.

A filter circuitry (light source control section) 4*a* shown in FIG. 5 includes a judging circuit (comparing section, difference calculating section) 27, a coefficient section (characteristic changing section) 28, multipliers (characteristic changing section) 29 and 30, an adder (characteristic changing section) 31, and a memory circuit (comparing section) 16*a*.

The filter circuitry 4*a* receives a peak value signal 12*a* as a target value and supplies it to the judging circuit 27 and the multiplier 29.

The judging circuit 27 compares the peak value signal 12*a* with memory data 37, which derives from a filter output signal 17*a* of the last frame stored in the memory circuit 16*a*, so as to obtain, for example, a difference of the two values and output a control signal 32 to the coefficient section 28.

The coefficient section 28, using the control signal 32, outputs coefficients 33 and 34, which are used to determine a filter characteristic.

The multiplier 29 calculates a product 35 of the peak value signal 12*a* (target value) and the coefficient 33, and outputs it to the adder 31.

The multiplier 30 calculates a product 36 of the coefficient 34 and the memory data 37, and outputs it to the adder 31.

The adder 31 calculates a sum of the product 35 and the product 36, and outputs the sum as the filter output signal 17*a*. The filter output signal 17*a* is also supplied to the memory circuit 16*a*.

The following describes the foregoing operations in more detail. It is assumed here that the coefficient 33 has a value s ($0<s<1$), and the coefficient 34 has a value $1-s$.

Further, the peak value signal 12*a* is $X_n$, and the memory data 37 stored in the memory circuit 16*a* is $Y_{n-1}$. Then, the product of the coefficient 33 and the peak value signal 12*a* in the multiplier 29 becomes $sX_n$, and the product of the coefficient 34 and the memory data 37 in the multiplier 30 becomes $(1-s)Y_{n-1}$.

From this it follows that the filter output value 17*a* produced by the adder 31 is $sX_n+(1-s)Y_{n-1}$.

That is, if the filter output signal 17*a* is denoted by $Y_n$, then $Y_n=sX_n+(1-s)Y_{n-1}=s(X_n-Y_{n-1})+Y_{n-1}$.

In this manner, according to the structure shown in FIG. 5, a peak value obtained in the peak value detector 3 is used as a target value, and a difference of the target value and the current value is obtained. The current value is then varied to approach the target value according to the difference.

Here, such a value is selected for the coefficient s that the filter characteristics shown in FIG. 2 are obtained according to a difference $(X_n-Y_{n-1})$ of the peak value signal 12*a* and the memory data 37, taking into account the frame interval F for example.

More specifically, for example, when the coefficient 33 and the coefficient 34 are 1/8 and 7/8, respectively, a recursive low-pass filter with $Y_n=(1/8)X_n+(7/8)Y_{n-1}$ is selected. By combining these coefficients in pairs of 1/16 and 15/16, 1/32and 31/32, and so on, various low-pass filters of different responses can be obtained. Thus, based on the control signal 32 that is obtained by calculating the difference of the peak value signal 12*a* and the memory data 37 in the judging circuit 27, the value s of the coefficient 33 and the value $1-s$ of the coefficient 34 in the coefficient unit 28 may be varied according to the sign of the difference.

Note that, in the described structure, a filter of the simplest form is used. However, use of more complex filters is also possible. For example, more than one filter of the same kind, as that shown in FIG. 5 for example, may be used in combination, so as to select a filter according to the brightness of the input video signal. In this way, the displayed image will be in more conformity with of the visual characteristics.

Figure 6:
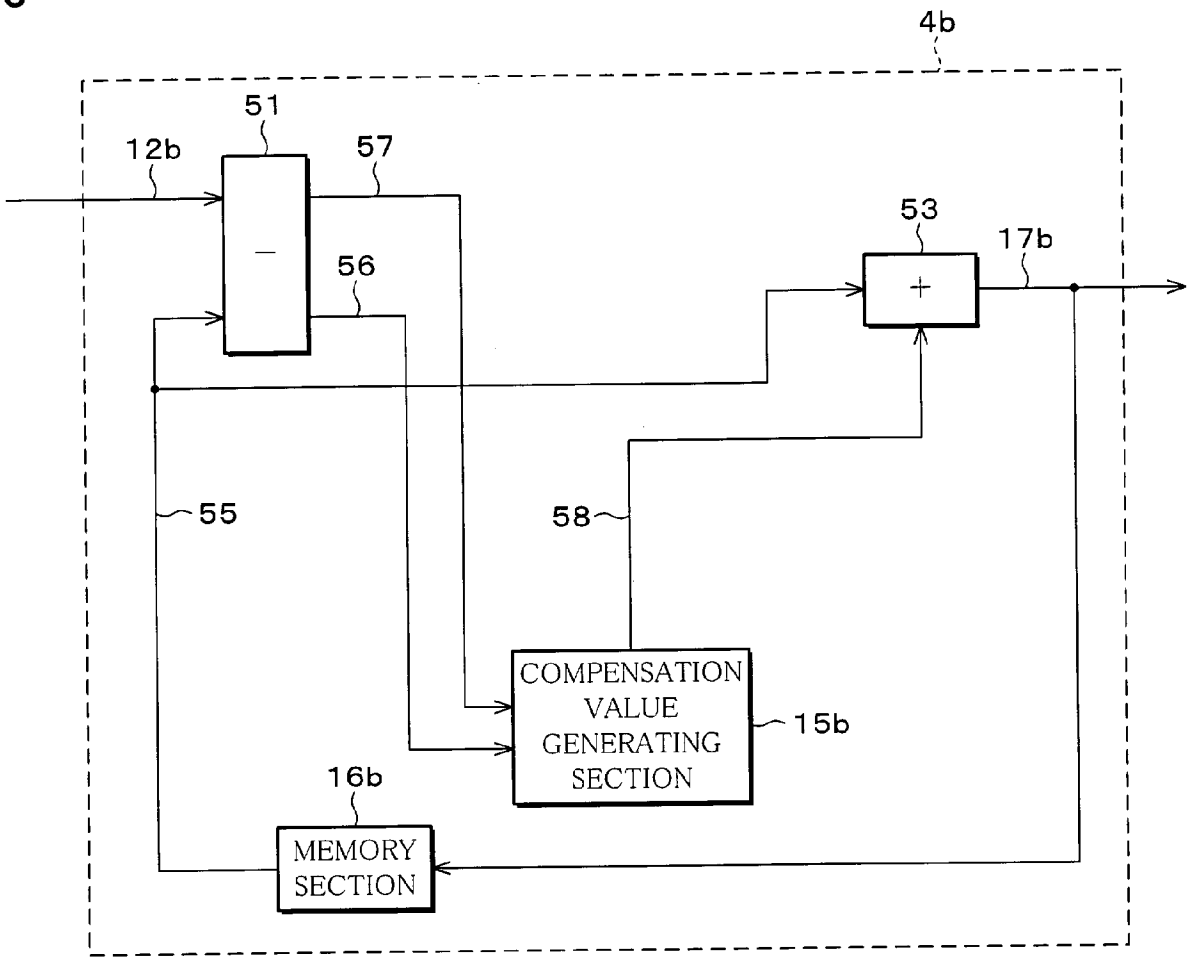
FIG. 6 is a block diagram showing another example of the filter circuit section of the image display device.

Referring to FIG. 6, the following describes a filter circuitry (light source control section) 4*b* as a Second Example of the filter circuitry 4 with regard to the function of light adaptation.

As shown in FIG. 6, the filter circuitry 4*b* includes a subtractor (comparing section) 51, an adder (characteristic changing section) 53, a compensation value generating section (characteristic changing section) 15*b*, and a memory circuit (comparing section) 16*b*.

Here, the memory circuit 16*b* corresponds to the memory circuit 16 of FIG. 1, and the compensation value generating section 15*b* and the adder 53 correspond to the compensation value generating section 15 and the filter selecting circuit 14 of FIG. 1, respectively.

The subtractor 51 receives an output value 55, which is a filter output value 17*b* that had been stored in the memory circuit 16*b*, in addition to a peak value signal 12*b* as a target value.

The subtractor 51 calculates a difference (absolute value) 56 of the peak value signal 12*b* and the output value 55, and outputs the difference 56 to the compensation value generating section 15*b*. Further, the subtractor 51 determines a sign 57 of the difference of the peak value signal 12*b* and the output value 55, and outputs the sign 57 to the compensation value generating section 15*b*.

The compensation value generating section 15*b*, based on the difference 56 and the sign 57, outputs a compensation value 58 to the adder 53.

That is, a filter characteristic is selected according to the difference of the peak value signal 12*b* and the output value 55, and an output value is produced according to the filter characteristic so selected. In the structure of FIG. 5 as described above, a difference of the current value and the target value is obtained, and the product of the difference and the coefficients is added to the current value to reach the target value. On the other hand, in the structure of FIG. 6, such a compensation value 58 is selected that, for example, the product calculation will not be necessary. The compensation value 58 is then added to the current value, i.e., the output value 55, so as to approach the target value, i.e., the peak value signal 12*b*. It should be noted that the result will be the same when the sign of the compensation value from the compensation value generating section 15*b* is opposite and when a subtractor is used instead of the adder 53. Further, the filter circuitry 4*b* may include a substractor and a selector in addition to the adder 53. In this case, the subtractor receives the output value 55 and the compensation value 58. The selector receives the output of the adder 53 and the output of the subtractor, and the sign 57. The selector selects either the output of the adder 53 or the output of the subtractor according to the sign 57, so as to output it as the filter output value 17*b*. The structure shown in FIG. 6 does not require a selector or a subtractor, which is advantageous in keeping the circuit scale at small level.

The following describes the foregoing operations in more detail.

If the sign 57 of the difference of the peak value signal 12*b* and the output value 55 is positive, the compensation value generating section 15*b* outputs the compensation value 58 according to the difference 56 with the positive sign.

The adder 53 receives the output value 55, which is the current value, and the compensation value 58 from the compensation value generating section 15*b*, and outputs the sum of these values as the filter output 17*b*. If the sign 57 of the difference of the peak value signal 12*b* and the output value 55 is negative, the operations proceed as follows.

Namely, the compensation value generating section 15*b* outputs the compensation value 58 according to the difference 56 with the negative sign.

The adder 53 receives the output value 55, which is the current value, and the compensation value 58 from the compensation value generating section 15*b*, and outputs the sum of these values as the filter output 17*b*.

The filter output (selector output) 17*b* is supplied to the memory circuit 16*b* and the lighting circuit 5.

As described, in the configuration shown in FIG. 6, the peak value obtained from the peak value detector 3 is used as a target value, and a difference between the current value and the target value is determined. The current value is then varied to approach the target value according to the difference. That is, the input target value is compared with the current value, which is the last output stored in the memory circuit 16*b*, and the current output, which was calculated to approach the target value, is stored in the memory circuit 16*b*.

The structure shown in FIG. 6 additionally includes an adder and a subtractor, such as the adder 53 and the subtractor 51, in the structure of FIG. 5. Such a circuit structure does not require the multiplier 29 or 30, making it possible to realize the circuit in a small scale.

Figure 7:
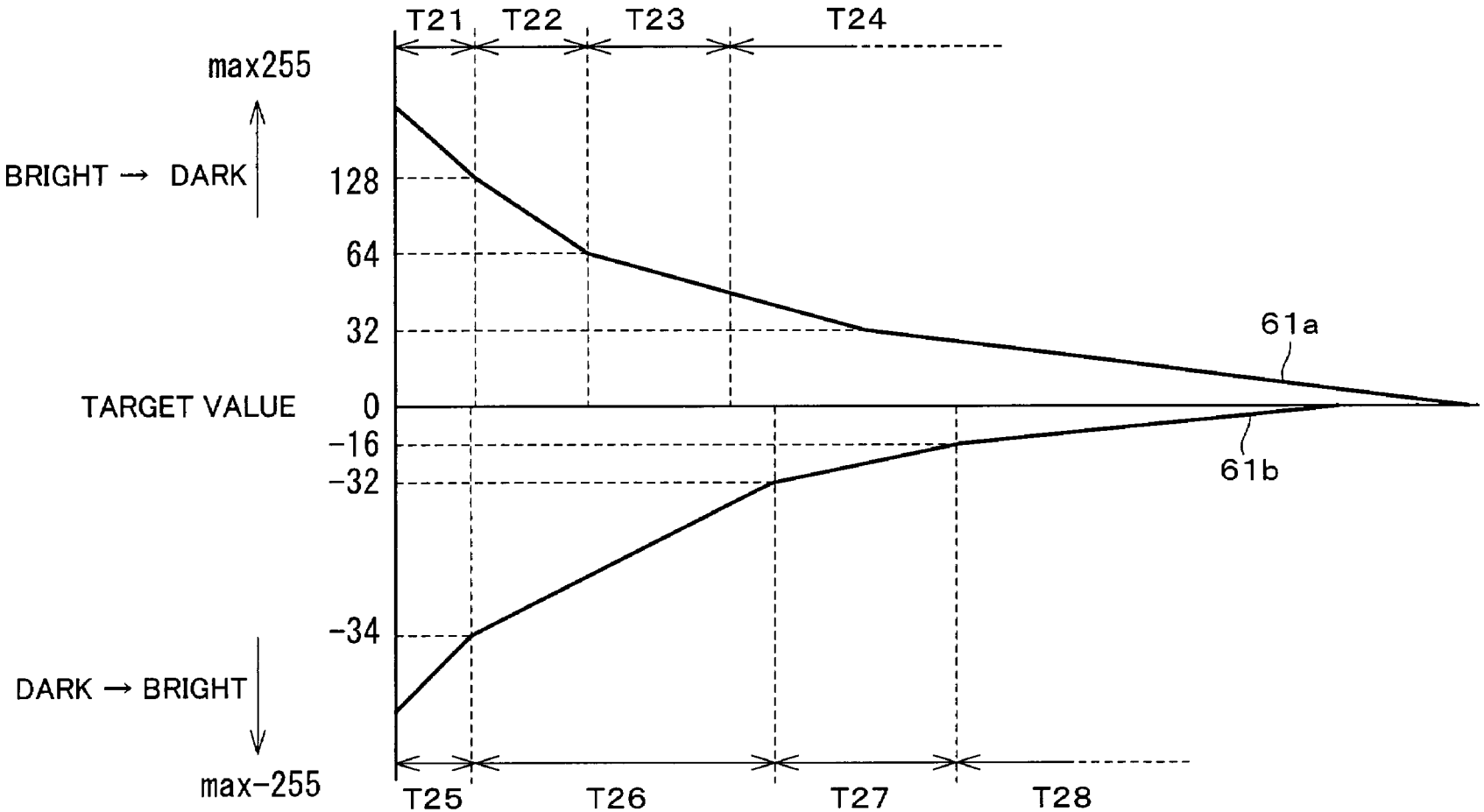
FIG. 7 is a graph showing characteristics of the filter circuit section.
Figure 8:
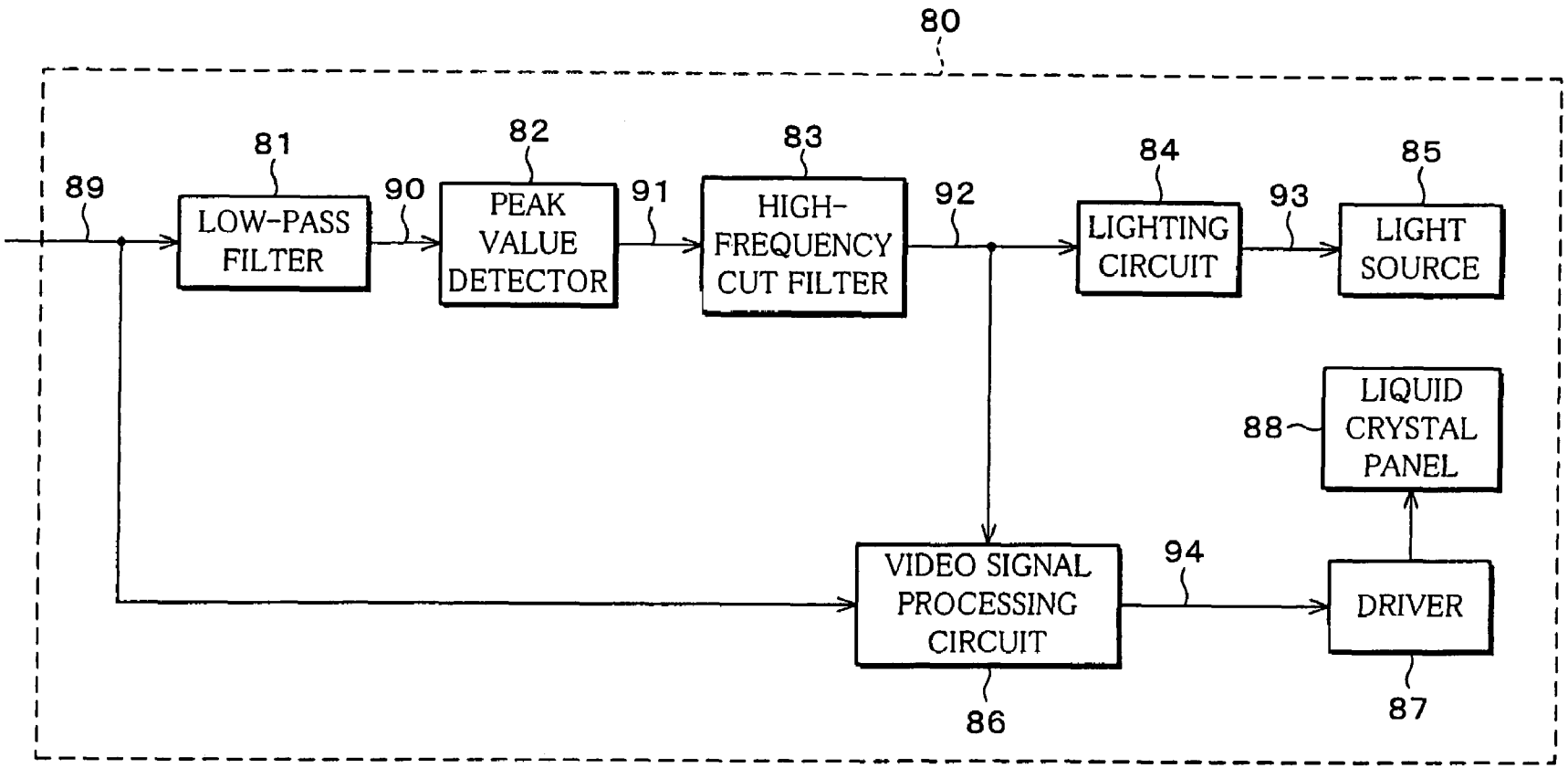
FIG. 8 (PRIOR ART)
FIG. 8 is a block diagram schematically showing an image display device of a conventional example.
Figure 9:
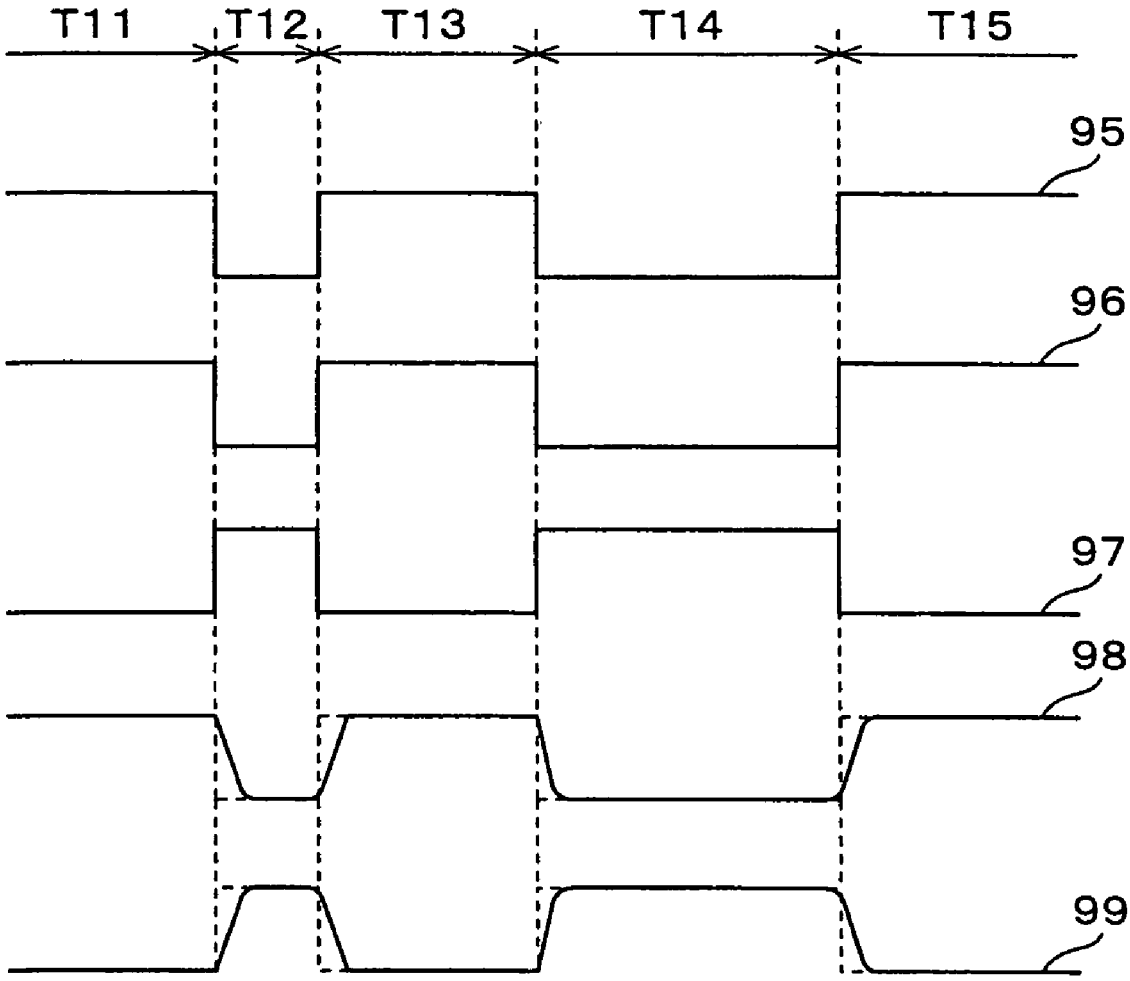
FIG. 9 (PRIOR ART)
FIG. 9 is a timing chart showing one example of how signals processed in the image display device change as a function of time.

Referring to FIG. 7, the following describes one specific example of filter characteristics that are realized by the filter circuitry 4*b* of the structure shown in FIG. 6.

Filter characteristics 61*a* and 61*b* shown in FIG. 7 have substantially the same characteristics as those shown in FIG. 2 except that they are more specifically described here.

The vertical axis in FIG. 7 indicates the filter output signal (current value) of the last frame with respect to the target peak value signal. Note that, in this example, the video signal has the maximum value of 255. The horizontal axis in FIG. 7 indicates time.

Reference signs T21 through T24 assigned to the filter characteristic 61*a* are time periods, respectively indicating sections of the filter characteristic. The slope of the filter characteristic 61*a* in section T21 is −16, where the slope is the amount of change of gradations per unit time. Here, a unit time indicates the time period of 128 frames.

The slope of the filter characteristic 61*a* in section T22 is −12, and that in T23 is −8 and that in T24 is −1.

On the other hand, reference signs T25 through T28 assigned to the filter characteristic 61*b* are time periods, respectively indicating sections of the filter characteristic 61*b*. The slopes of the filter characteristic 61*b* in sections T25, T26, T27, and T28 are 120, 16, 8, and 1, respectively.

The following considers the case where the peak value signal 12*b* supplied to the filter circuitry 4*b* changes from 255 to 127. For simplicity, it is assumed here that the value of the peak value signal 12*b* changes to 127 after a sufficiently long period of 255. In this case, because the peak value of the input video signal changes from 255 to 127, the display changes from bright to dark. In the filter circuitry 4*b*, the value of the peak value signal 12*b* is 127, and the output value 55 is 255. Accordingly, the difference 56 from the subtractor 51 is 128 and the sign 57 is positive.

From the filter characteristics 61*a* and 61*b* shown in FIG. 7, the compensation value generating section 15*b* selects the filter characteristic 61*a* according to the sign 57. The value of the difference 56 is 128, and from this value the slope −16 of the corresponding section T21 of the filter characteristics 61*a* can be found. The compensation value generating section 15*b*, using the slope −16 and the time per frame ($1/128$), outputs the compensation value 58 of ($-16/128$).

The adder 53 adds the value 255 of the output value 55 and the value ($-16/128$) of the compensation value 58, and outputs the sum (254.875) of these values as the filter output 17*b*. The filter output 17*b* is then stored in the memory circuit 16*b* and supplied to the lighting circuit 5, so as to vary the output level of the light.

The following considers the next frame in which the value of the peak value signal 12*b* into the filter circuitry 4*b* is 127.

In this case, the value of the peak value signal 12*b* into the filter circuitry 4*b* is 127, and the output value 55 is 254.875. Accordingly, the difference 56 supplied from the subtractor 51 is 127.875 and the sign 57 is positive.

The compensation value generating section 15*b* selects the filter characteristic 61*a*, and using the value 127.875 of the difference 56, finds the slope −12 of the section T22, and outputs the compensation value 58 ($-12/127.875$).

The adder 53 adds the value 254.875 of the output value 55 and the value ($-12/127.875$) of the compensation value 58, so as to output the sum (254.781) of these values as the filter output 17*b*.

The operation of the foregoing control is repeated in the subsequent frames, so that the output value 55, which is the current peak value, approaches the target value 127 in each frame. The rate of approach gradually decreases as the value approaches and becomes equal to the target value.

The following considers the case where the peak value signal 12*b* into the filter circuitry 4*b* varies from 127 to 255. For simplicity, it is assumed here that the value of the peak value signal 12*b* changes to 255 after a sufficiently long period of 127, i.e., from dark display to bright display.

Here, the value of the peak value signal 12*b* is 255 and the output value 55 is 127 in the filter circuitry 4*b*. Accordingly, the value of the difference 56 from the subtractor 51 is 128 and the sign 57 is negative.

The compensation value generating section 15*b* selects the filter characteristic 61*b*, and using the value 128 of the difference 56, finds the slope 120 of the section T25, and outputs the compensation value 58 of ($120/128$). In this case, as in the foregoing control operation, the output value 55, which is the current output value, approaches the target value 255. The rate of approach gradually decreases as the value approaches and becomes equal to the target value.

Here, the slope of the section T25 on the filter characteristic 61*b* is 120, and the slope of the section T21 on the filter characteristic 61*a* is −16.

Thus, when the input video signal has the maximum value 255 and when the difference from the last output signal is 128 or greater, the rate of change of output characteristic according to a gradation change from dark display to bright display is 7 times faster than that from bright display to dark display, on the basis of absolute values. That is, the rate of change of output characteristic in a display change from dark to bright is about 8 times faster than that in a display change from bright to dark. That is, the target value is reached faster when the display change is from dark to bright than it is from bright to dark.

In the described manner, when the difference of the input video signal and the last output signal exceeds half of the total gradation levels, the rate of change of output characteristic according to a gradation change from dark display to bright display is made 6 times to 10 times faster than that from bright display to dark display.

Thus, when there is a large gradation change, the output characteristic immediately following the gradation change is changed so that the rate of change of the output characteristic is at least 7 times faster when the gradation change is from dark to bright than it is from bright to dark.

In this way, a bright state gradually changes to a dark state, and the "bright black display", which may occur when the display changes from bright to dark, can be prevented.

In section T21 of the filter characteristic 61*a*, the value of the last output signal with respect to the input video signal (difference of the last output signal and the input video signal) is positive and greater than half of the total gradation levels. The number of gradations that decreases per unit time in this section is 16, which is no greater than 1/16 of the total gradation levels. With this slow rate of decrease, a change in output level of light can be perceived smoothly according to the visual characteristics.

As described, the image display device 1 according to the present embodiment includes the comparing and judging circuit 13 as a comparing section, the filter selecting circuit 14 as a characteristic changing section, and the compensation value generating section 15 as a characteristic changing section.

According to this configuration, in addition to displaying the video signal 10 in the liquid crystal panel 9, the video signal 10 is also compared with the memory data 20, which is the output signal 17 of the last output, and the output value is controlled according to the result of comparison. In this way, display flicker can be prevented. The foregoing embodiment described the case where signals of adjacent frames are compared with each other to change the output characteristic per frame. However, the present invention is not just limited to this implementation.

For example, the present invention may be adapted to refer to signals of successive frames to change the output characteristic per frame. In this way, by referring to a plurality of signals, the output characteristic can be determined more precisely. In this case, it is preferable to use a memory section such as the memory circuit 16, so that signals of successive frames are stored in the memory section and read out therefrom to be compared with the input video signal.

Further, signals of predetermined frames, for example, such as every two frames or every three frames may be compared to change the output characteristic. In this way, a fewer comparisons need to be made, which is advantageous in reducing power consumption for example.

Further, as described, the image display device according to the present invention may be adapted so that the comparing section is a difference calculating circuit that calculates a difference of the video signal and the last output signal, and the characteristic changing section includes: a coefficient section, which outputs a first coefficient and a second coefficient according to the difference; a first multiplier, which calculates a first product of the video signal and the first coefficient; a second multiplier, which calculates a second product of the output signal of the last frame and the second coefficient; and an adder, which calculates a sum of the first product and the second product.

According to this configuration, the image display device, in response to the video signal, calculates a difference of the video signal and the last output signal, and generates a first coefficient and a second coefficient according to the difference. The image display device then calculates a first product, which is the product of the video signal and the first coefficient, and a second product, which is the product of the last output signal and the second coefficient, so as to output the sum of the first and second products as an output signal.

In this way, the image display device can be realized in a simple structure. In addition, by adjusting the output coefficients of the coefficient section, the output signal level can be adjusted more easily and finely.

Further, as described, the image display device according to the present invention may be adapted so that the comparing section calculates a difference of the video signal and the last output signal, and the characteristic changing section adds or subtracts a compensation value, which is created according to an absolute value and a sign of the difference, to or from the last output signal according to the sign of the difference.

According to this configuration, the image display device, in response to the video signal, calculates a difference of the video signal and the last output signal, and adds or subtracts a compensation value, which is created according to an absolute value and a sign of the difference, to or from the last output signal according to the sign of the difference.

For example, if the difference is positive (negative if the difference is calculated with respect to the video signal), the compensation value is added to the last output signal, so as to increase the output signal. On the other hand, if the difference is negative, the compensation value is subtracted from the last output signal, so as to decrease the output signal. Note that, depending on the sign of the compensation value (negative in this case), the compensation value may be added to the output signal to decrease the output signal. The value obtained by addition or subtraction is outputted as an output signal.

The foregoing configuration does not require a multiplier for example, making it possible to realize the circuit in a smaller scale. That is, with the foregoing configuration, the circuit can be realized in a smaller scale by eliminating the multiplier by the filter structure of adder or subtractor performing addition or subtraction.

Further, as described, the image display device according to the present invention may be adapted so that, if a difference of the video signal and the last output signal is greater than half of total gradation levels, the characteristic changing section changes a changing rate of output of the light source control section, so that the changing rate is at least six times faster when the difference is negative than it is when the difference is positive.

According to this configuration, a bright state gradually changes to a dark state (if the difference is positive), and the "bright black display", which may occur when the display changes from bright to dark, can be prevented. In other words, the image display device according to the present invention changes the rate of output change of the light source control section, so that the rate is at least six times slower when the difference is positive than it is when the difference is negative.

In another aspect of the present invention, the characteristic changing section changes the output characteristic of the light source control section so that the rate of increase of light output level is at least 8 times faster than the rate of decrease.

Further, as described, the image display device according to the present invention may be adapted so that, if a difference of the video signal and the last output signal is positive and is greater than half of total gradation levels, the characteristic changing section changes the gradation levels, so that the gradations levels decreasing per unit time do not exceed 1/16 of the total gradation levels.

With such a slow rate of decrease, a change in output level of light can be perceived smoothly by the visual characteristics. That is, it is ensured that a bright display state slowly changes to a dark display state (if the difference is positive), thereby preventing "bright black display" without fail.

Note that, in another aspect of the present invention, the output characteristic of the light source control section changed by the characteristic changing section is such that the rate of decrease of the light output level decreased by means of changing the light output level is at least 17 seconds slower when the light output level decreases to half the peak output level.

In the event where the target value is a fixed value rather than a value that is generated according to the level of the input video signal, the output level of light is calculated from the difference of the fixed value and the current value. In this case, because the difference from the current value is large, reducing the output level of light in response to the input of dark display does not enable the display compensation operation to follow the peak value of the input video signal unless the output level of the light is increased immediately. As a result, the output level of light is increased to the peak level of the video signal, causing saturation by the displayed image.

In this case, even when the dark display is held for an extended time period, the low light output level can be maintained only for a short time period. Accordingly, the effect of reducing "bright black display" can be obtained to the limited extent.

This drawback can be overcome by the provision of a circuit that calculates the difference of the current value and the target value that is in accordance with the video signal, a compensation generating circuit that generates a coefficient of the filter characteristic, and a circuit that holds the value of intensity that was produced through an adder and a subtractor. In this case, a low output level of light can be maintained for an extended time period when a dark image is displayed over a long period. This reduces the "bright black display" for a longer time period, thus obtaining a high-contrast and high-quality image.

Further, according to the foregoing configuration, the filter selected by the comparing and judging section increases the output light level at least six times faster than when it is decreased. This enables the display compensation operation of the display device to sufficiently follow the peak value of the input video signal, thereby increasing the output light level without causing saturation by the displayed image. Further, it is possible to eliminate flicker, which may be caused when there is an abrupt change in an output level of black display. That is, one effect of the foregoing configuration is that it can prevent "bright black display" for extended periods of time, so as to produce high-contrast and high-quality images. Another effect is that the display compensation operation can sufficiently follow the video signal to prevent saturation caused by the video signal, thereby eliminating flicker, which may be caused when there is an abrupt change in an output level of black display.

Further, the characteristic of the filter is such that the current peak value reaches the target value at such a rate that the rate becomes slower as the current peak value approaches the target value. This enables the filter to be weighted differently depending on whether the difference from the target value is large or small. That is, the output light level is changed at a fast rate when the difference from the target value is large, whereas the same output light level is maintained when the difference is small, by regarding the difference as a noise. In the event where the difference of the target value and the current peak value is large, changing the output light level in a short period of time and suddenly ending it upon reaching the target value causes the change of the output light level to be perceived as flicker. By gradually slowing the rate of change, the change of the output light level can be perceived smoothly.

As described above, an image display method according to the present invention includes the step of comparing the video signal with the last output signal, and the step of generating an output signal according to the result of comparison in the comparing step.

According to this method, in the step of generating an output signal, not only the current video signal but also the last output signal is used. As a result, a suitable output signal can be generated, taking into account saturation of human visual perception.

In a conventional image display method, only the current video signal is used to control the output of the light source according to the output signal. That is, conventionally, no consideration is given to saturation of human visual perception.

In the step of generating an output signal, the output signal may be produced so as to change a changing rate of the output of the light source according to whether the result of comparison in the comparing step indicates increase or decrease.

In this way, a high-contrast image can be displayed, for example, by abruptly increasing the intensity when the video signal changes from dark to bright, and by gradually increasing the intensity when the video signal changes from bright to dark.

Further, if the difference of the video signal and the last output signal calculated in the comparing step is greater than half of total gradation levels, the output signal may be generated by changing a changing rate of the output of the light source, so that the changing rate is at least six times slower when the difference is positive than when the difference is negative. In this way, it is ensured that a high-contrast image is displayed.

Further, if the difference of the video signal and the last output signal calculated in the comparing step is greater than half of the total gradation levels, the output signal may be generated by changing the gradation levels, so that the gradation levels decreasing per unit time do not exceed 1/16 of the total gradation levels when the difference is positive. This ensures that a bright state gradually changes to a dark state (when the difference is positive), thus preventing "bright black display" without fail.

As described, the present invention provides an image display device that controls the video signal and the lighting circuit according to the input video signal, so as to improve contrast, so that flicker or "bright black display", which may be caused when the display characteristics do not match the human visual characteristics, is eliminated.

To this end, the image display device of the present invention is provided with the filter circuitry 4, in which the filter selecting circuit 14 changes the filter characteristic according to the difference of the video signal 10 and the memory data 20 stored in the memory circuit 16, so as to output the filter output signal 17. The filter circuitry 4 selects different filter characteristics for the display change from dark to bright and for the display change from bright to dark. This prevents display flicker, which may be caused due to saturation of human visual perception with respect to changes in gradation and illuminance level.

While this invention has been described with a reference to illustrative embodiments, the description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. An image display device, comprising:

a light source;

a display panel, which outputs light from the light source by controlling intensity of the light according to a level of a video signal;

a light source control section to control an output of the light source according to an output signal that is generated according to a level of the video signal, the light source control section including, a comparing section to compare the video signal with a previous output signal, and a characteristic changing section to vary an output of the light source according to the result of comparison, wherein the comparing section is a difference calculating circuit that calculates a difference of the video signal and the previous output signal, and wherein the characteristic changing section includes:

a coefficient section, which outputs a first coefficient and a second coefficient according to the difference;

a first multiplier, which calculates a first product of the video signal and the first coefficient;

a second multiplier, which calculates a second product of the previous output signal and the second coefficient; and an adder, which calculates a sum of the first product and the second product.

2. An image display device, comprising:

a light source;

a display panel, which outputs light from the light source by controlling intensity of the light according to a level of a video signal; and a light source control section to control an output of the light source according to an output signal that is generated according to a level of the video signal, the light source control section including, said image display device further comprising:

a comparing section to compare the video signal with a last previous output signal and calculate a difference of the video signal and a previous output signal, so as to output a result of comparison; and a characteristic changing section to change, add or subtract a compensation value, in accordance with the calculated difference, to or from the previous output signal to vary an output characteristic of the light source control section according to the result of comparison, wherein, if a difference of the video signal and the previous output signal is greater than half of total gradation levels, the characteristic changing section changes a changing rate of output of the light source control section, so that the changing rate is at least six times faster when the difference is negative than it is when the difference is positive.

3. An image display device, comprising:

a light source;

a display panel, which outputs light from the light source by controlling intensity of the light according to a level of a video signal; and a light source control section to control an output of the light source according to an output signal that is generated according to a level of the video signal, the light source control section including, said image display device further comprising:

a comparing section to compare the video signal with a last previous output signal and calculate a difference of the video signal and a previous output signal, so as to output a result of comparison; and a characteristic changing section to change, add or subtract a compensation value, in accordance with the calculated difference, to or from the previous output signal to vary an output characteristic of the light source control section according to the result of comparison, wherein, if a difference of the video signal and the previous output signal is positive and is greater than half of total gradation levels, the characteristic changing section changes gradation levels, so that the gradation levels decreasing per unit time do not exceed 1/16 of the total gradation levels.

4. An image display method for controlling an output of a light source for illuminating a display panel that displays a video signal, in accordance with an output signal that is produced using the video signal, comprising the steps of:

comparing the video signal with a previous output signal; and producing an output signal according to a result of the comparison so as to change a changing rate of the output of the light source according to whether a result of the comparison indicates an increase or decrease;

wherein in said comparing step, a difference of the video signal and the previous output signal is calculated, and if the difference of the video signal and the previous output signal is greater than half of total gradation levels, a changing rate of the output of the light source is changed in said producing step, so that the changing rate is at least six times slower when the difference is positive than it is when the difference is negative.

5. An image display method for controlling an output of a light source for illuminating a display panel that displays a video signal, in accordance with an output signal that is produced using the video signal, comprising the steps of:

comparing the video signal with a previous output signal; and producing an output signal according to a result of the comparison so as to change a changing rate of the output of the light source according to whether a result of the comparison indicates an increase or decrease;

wherein a difference of the video signal and the previous output signal is calculated in said comparing step, and if a difference of the video signal and the previous output signal is greater than half of total gradation levels, gradation levels are changed in said producing step, so that the gradation levels changing per unit time do not exceed 1/16 of the total gradation levels if the difference is positive.

* * * * *